US009144331B2

(12) United States Patent
Gold

(10) Patent No.: US 9,144,331 B2
(45) Date of Patent: Sep. 29, 2015

(54) PEG HOOK STAPLE

(71) Applicant: Thomas Elliott Gold, El Paso, TX (US)

(72) Inventor: Thomas Elliott Gold, El Paso, TX (US)

( * ) Notice: Subject to any disclaimer, the term of this patent is extended or adjusted under 35 U.S.C. 154(b) by 140 days.

(21) Appl. No.: 14/168,913

(22) Filed: Jan. 30, 2014

(65) Prior Publication Data

US 2015/0129730 A1 May 14, 2015

Related U.S. Application Data

(60) Provisional application No. 61/904,081, filed on Nov. 14, 2013.

(51) Int. Cl.
*A47B 96/06* (2006.01)
*A47F 5/08* (2006.01)

(52) U.S. Cl.
CPC ..... *A47F 5/0823* (2013.01); *A47F 5/08* (2013.01); *A47F 5/0815* (2013.01)

(58) Field of Classification Search
CPC ..... A47F 5/0823; A47F 5/08; A47F 5/0869
USPC ..... 248/220.31, 220.41, 220.42, 216.1, 248/225.21, 303, 304, 339; 211/43, 57.1, 211/59.1, 70.6, 71.01, 85.18, 87.01, 106.01
See application file for complete search history.

(56) References Cited

U.S. PATENT DOCUMENTS

| | | | | | |
|---|---|---|---|---|---|
| 4,105,179 | A | * | 8/1978 | Elliott | 248/220.43 |
| 4,714,221 | A | * | 12/1987 | Cawrey | 248/220.42 |
| 5,165,640 | A | * | 11/1992 | Williams, 3rd | 248/220.43 |
| D412,804 | S | * | 8/1999 | Romeo | D6/567 |
| D413,471 | S | * | 9/1999 | Romeo | D6/567 |
| 6,019,328 | A | * | 2/2000 | Allen | 248/220.31 |
| 7,481,406 | B2 | * | 1/2009 | Lang et al. | 248/220.31 |
| 8,511,485 | B2 | * | 8/2013 | Hernandez et al. | 211/70.6 |
| 2007/0241070 | A1 | * | 10/2007 | Maheu et al. | 211/59.1 |
| 2013/0105418 | A1 | * | 5/2013 | Northrup et al. | 211/4 |

* cited by examiner

*Primary Examiner* — Todd M Epps

(57) ABSTRACT

A peg hook staple is used in conjunction with at least one peg hook and a perforated wall board so that the at least one peg hook can be firmly secured to the perforated wall board through a first extremity and a second extremity of the peg hook staple. A handle portion of the peg hook staple allows the users to easily install and remove the peg hook staple. The peg hook staple eliminates lateral, upward, and outward movement of the at least one peg hook as a plurality of indentations of the peg hook staple secures the at least one peg hook to the perforated wall board.

20 Claims, 11 Drawing Sheets

PEG HOOK STAPLE

The current application claims a priority to the U.S. Provisional Patent application Ser. No. 61/904,081 filed on Nov. 14, 2013.

FIELD OF THE INVENTION

The present invention relates generally to a peg hook device for all-purpose board panels. The present invention is a peg hook staple that is used in conjunction with a perforated composition panel board and peg board hooks so that variety of shapes and sizes of tools and components can be securely stored within the peg board hooks.

BACKGROUND OF THE INVENTION

A universal problem with current conventional peg board hooks is their looseness and tendency to detach and fall when an object is placed on or removed from the peg board hook. The S-shaped end of the peg board hook that is typically inserted into the peg board hole is usually the primary means of retaining method between the peg board hook and the peg board. Any slight upward or lateral movement often causes the S-shaped end of the peg board hook to dislodge from the peg board hole and fall. Many attempts and inventions have been made to remedy this problem, but the existing inventions do not perform effectively in all of these applications. All of or part of all existing inventions may or may not state the ability to prevent lateral movement of the peg board hook. While lateral movement does not cause disengagement of the peg board hook and only an upward and outward movement of the bottom portion of the peg board hook can cause disengagement, the lateral movement still causes the peg board hooks to misaligned with each other.

It is therefore an objective of the present invention to provide a peg hook staple that eliminates the lateral, upward, outward movement of the peg board hook. The present invention provides an improved component over all of the existing forms of securing devices that retain peg board hooks to the peg board. The present invention firmly secures a variety of shapes and sizes of wire hooks, loops, and other hanger shaped peg board hooks with a perforated composition board panel board, commonly known as peg board, to store or display tools, blister packs, envelopes, cards and a wide variety of other objects.

DETAIL DESCRIPTIONS OF THE INVENTION

Figure 1:
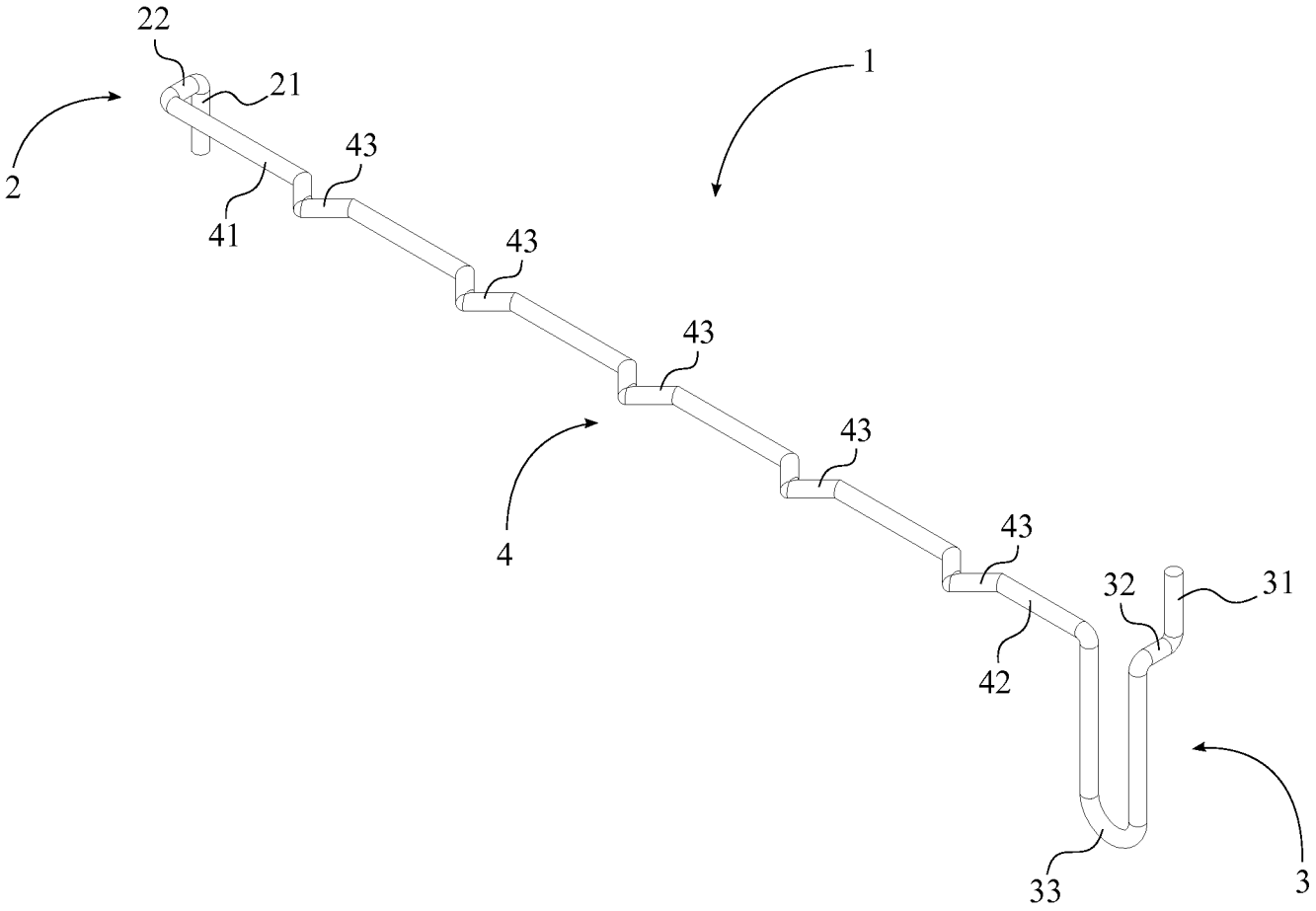
FIG. 1 is a perspective view of the present invention.

All illustrations of the drawings are for the purpose of describing selected versions of the present invention and are not intended to limit the scope of the present invention.

The present invention is a peg hook staple 1 that is used conjunction with a perforated wall board 6 and at least one peg hook 5. The present invention can be utilized with variety of shapes and sizes of the at least one peg hook 5 so that tools, blister packs, envelopes, cards, and a wide variety of other objects can be securely stored or displayed within the perforated wall board 6. The present invention provides substantial improvements over all existing forms of securing devices that would normally retain the peg hooks to the peg board. The peg hook staple 1 comprises a first extremity 2, a second extremity 3, and a peg-securing cross member 4, where the first extremity 2 and the second extremity 3 are oppositely positioned from each other along the peg-securing cross member 4. In the preferred embodiment of the present invention, the peg hook staple 1 comprises a circular cross-section; however, the present invention is not only limited to the circular cross-section and can be manufactured into any other geometric shapes.

In reference to FIG. 1-FIG. 5, the peg-securing cross member 4 that extends from the first extremity 2 to the second extremity 3 comprises a first end 41, a second end 42, and a plurality of indentations 43. The first end 41 and the second end 42 are oppositely positioned from each other along the peg-securing cross member 4. The length of the first end 41 is preferably larger than the length of the second end 42 so that other structural components of the present invention can be effectively positioned. The plurality of indentations 43 is positioned along the peg-securing cross member 4. More specifically, the plurality of indentations 43 is extended normal to a plane 7 that is coincident with the peg-securing cross member 4 as the plurality of indentations 43 is positioned in between the first end 41 and the second end 42. Additionally, the plurality of indentations 43 is evenly distributed along the peg-securing cross member 4 for the proper securing of the at least one peg hook 5. In the preferred embodiment of the present invention, each of the plurality of indentations 43 is shaped into a V-shaped configuration, where the configuration for each of the plurality of indentations 43 is not limited only to the V-shaped and can be any other shapes, such as U-shaped and C-shaped.

In reference to FIG. 1-FIG. 4, the first extremity 2 comprises a first locking protrusion 21 and a first retaining portion 22 as the first extremity 2 adjacently connected with the first end 41. The first extremity 2 functions as one of the securing end for the present invention so that the present invention can be attached to the perforated wall board 6 from one end. More specifically, the first retaining portion 22 is perpendicularly connected with the first end 41 in such way that the first retaining portion 22 is positioned normal to the plane 7 opposite from the plurality of indentations 43. The first locking protrusion 21 is perpendicularly connected with the first retaining portion 22, where the first locking protrusion 21 is perpendicularly positioned with the peg-securing cross member 4.

Figure 2:
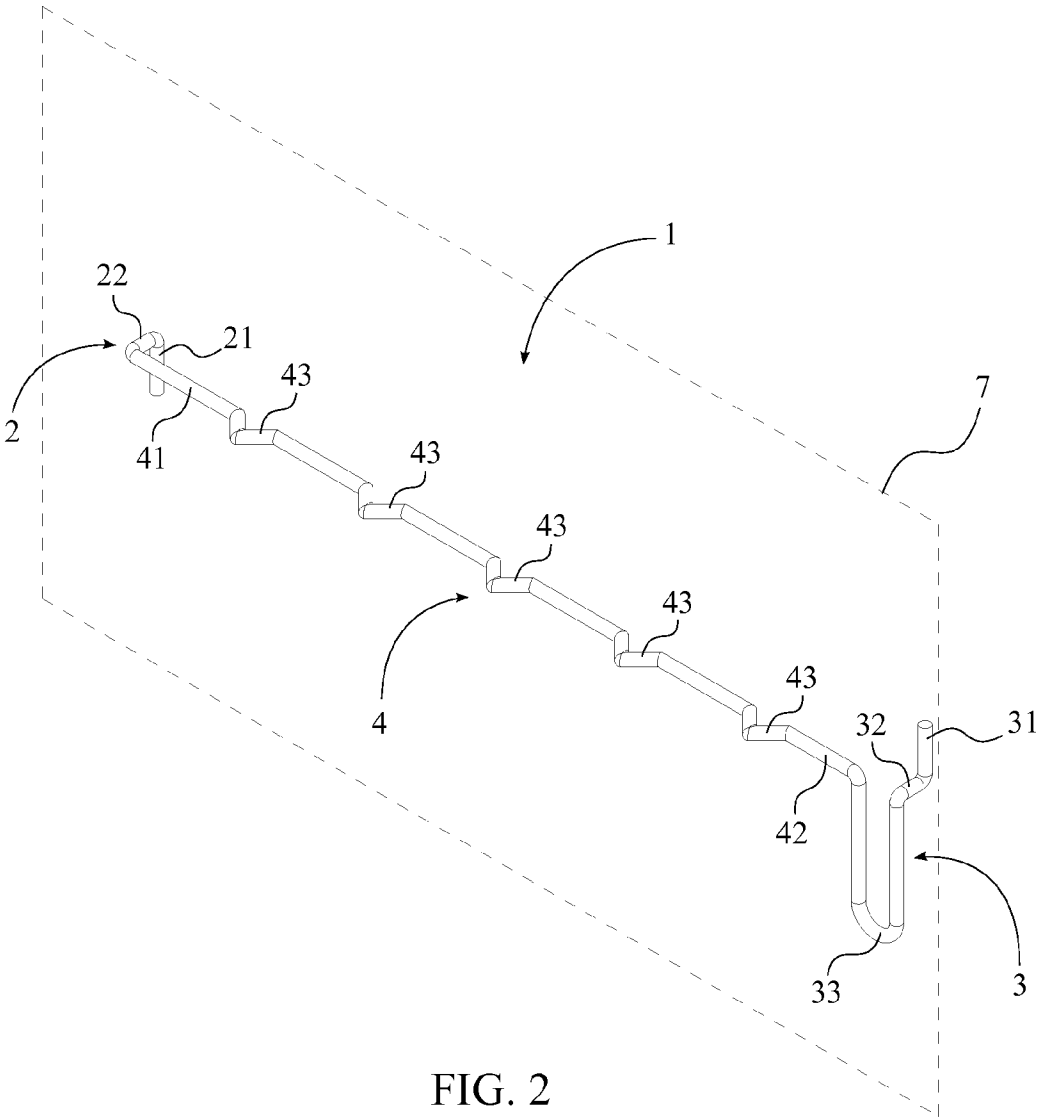
FIG. 2 is a perspective view of the present invention, wherein the dash lines illustrates the plane.
Figure 3:
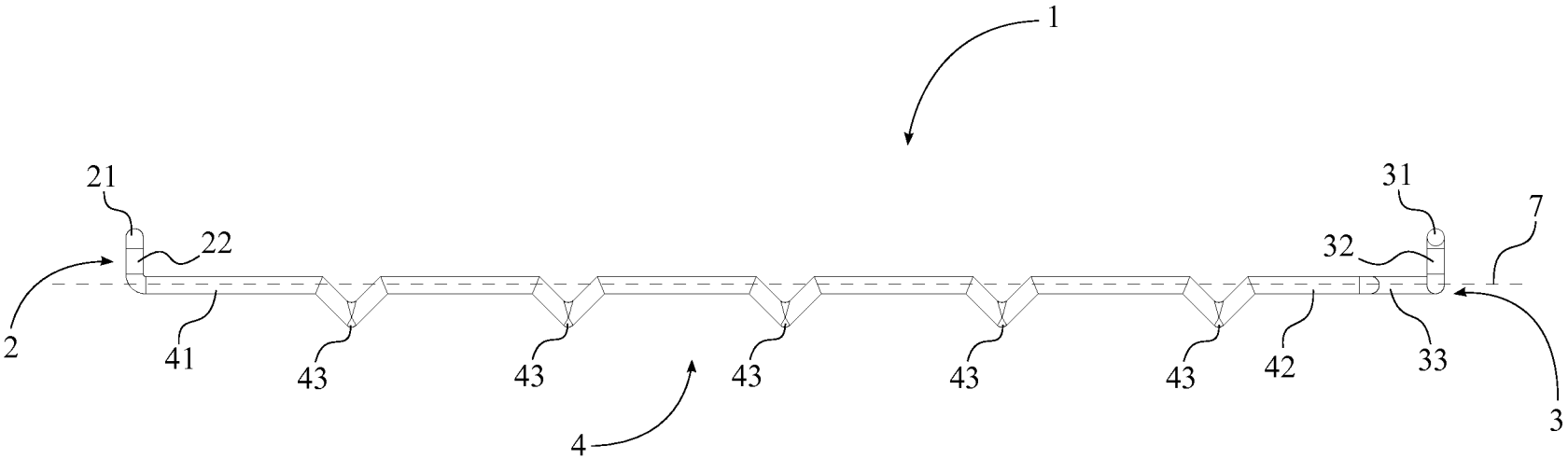
FIG. 3 is a top view of the present invention, wherein the dash lines illustrates the plane.

In reference to FIG. 1-FIG. 3, the second extremity 3 comprises a second locking protrusion 31, a second retaining portion 32, and a handle portion 33 as the second extremity 3 adjacently connected with the second end 42. The second extremity 3 functions as the second securing end for the present invention so that the present invention can be attached to the perforated wall board 6 from the opposite end. More specifically, the handle portion 33 is perpendicularly connected with the second end 42 in such way that the handle portion 33 is positioned parallel to the plane 7. The handle portion 33 provides a surface area so that the users of the present invention are able to securely grip the present invention during the installation process and the removal process of the present invention. Even though the handle portion 33 of the preferred embodiment of the present invention utilizes a U-shaped design, the handle portion 33 can include any other type of design as long as the handle portion 33 allows the users comfortably and efficiently to grip the present invention. The second retaining portion 32 is perpendicularly connected with the handle portion 33 in such way that the second retaining portion 32 is positioned normal to the plane 7 opposite from the plurality of indentations 43. The second locking protrusion 31 is perpendicularly connected with the second retaining portion 32, where the second locking protrusion 31 is perpendicularly positioned with the peg-securing cross member 4.

Figure 4:
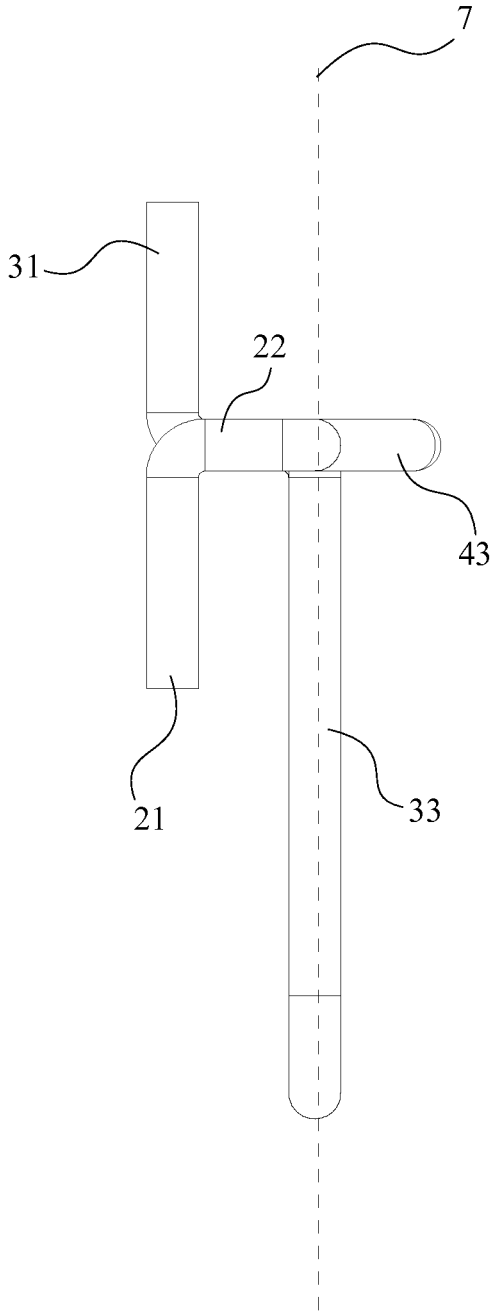
FIG. 4 is a side view of the present invention, wherein the dash lines illustrates the plane.
Figure 5:
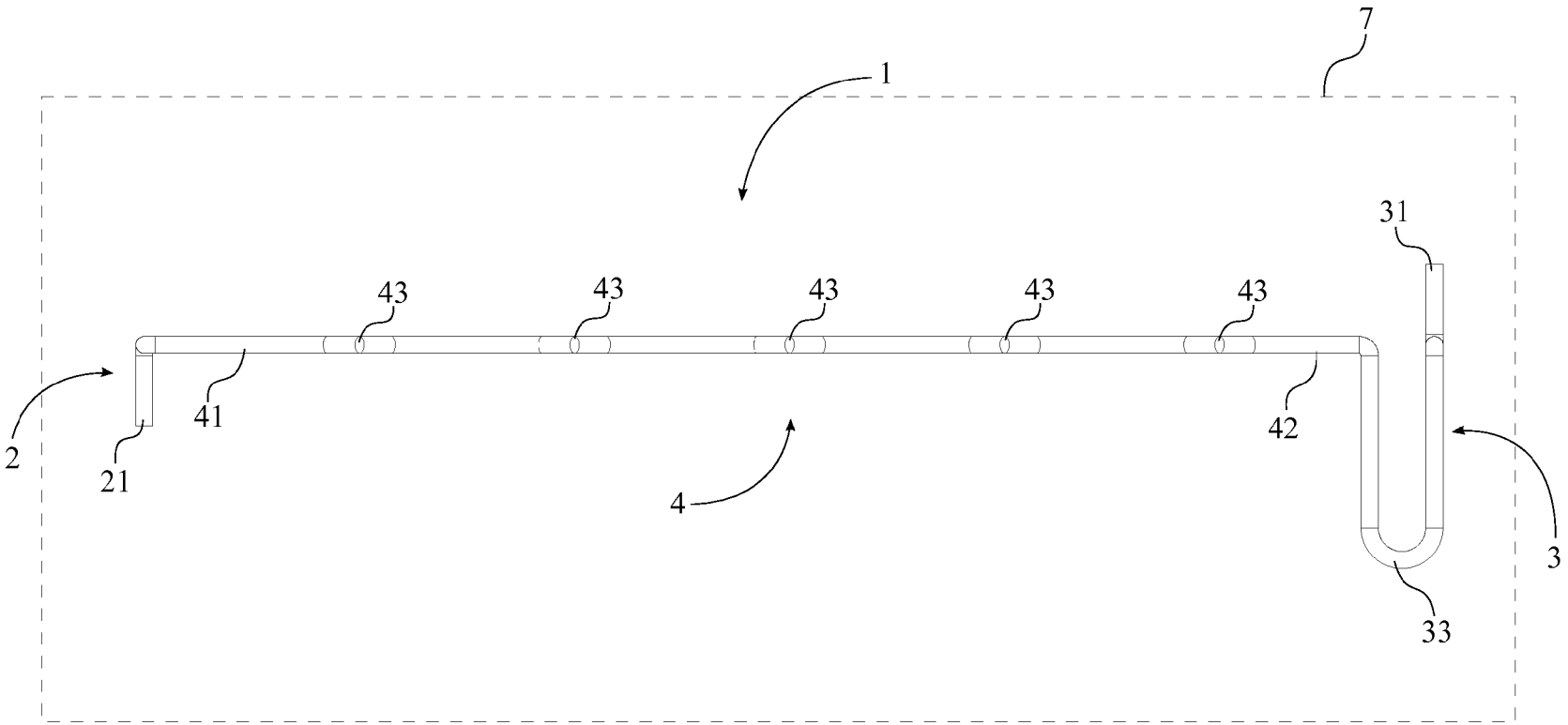
FIG. 5 is a front view of the present invention, wherein the dash lines illustrates the plane.

In reference to FIG. 4, the first locking protrusion 21 and the second locking protrusion 31 are oriented opposite to each other within the present invention; however, the first locking protrusion 21 is oriented in the same direction as the handle portion 33 for the proper placement of the present invention. For example, if the first locking protrusion 21 and the handle portion 33 are oriented in the downward direction, the second locking protrusion 31 is oriented in the upward direction. If the first locking protrusion 21 and the handle portion 33 are oriented in the upward direction, the second locking protrusion 31 is oriented in the downward direction.

Figure 6:
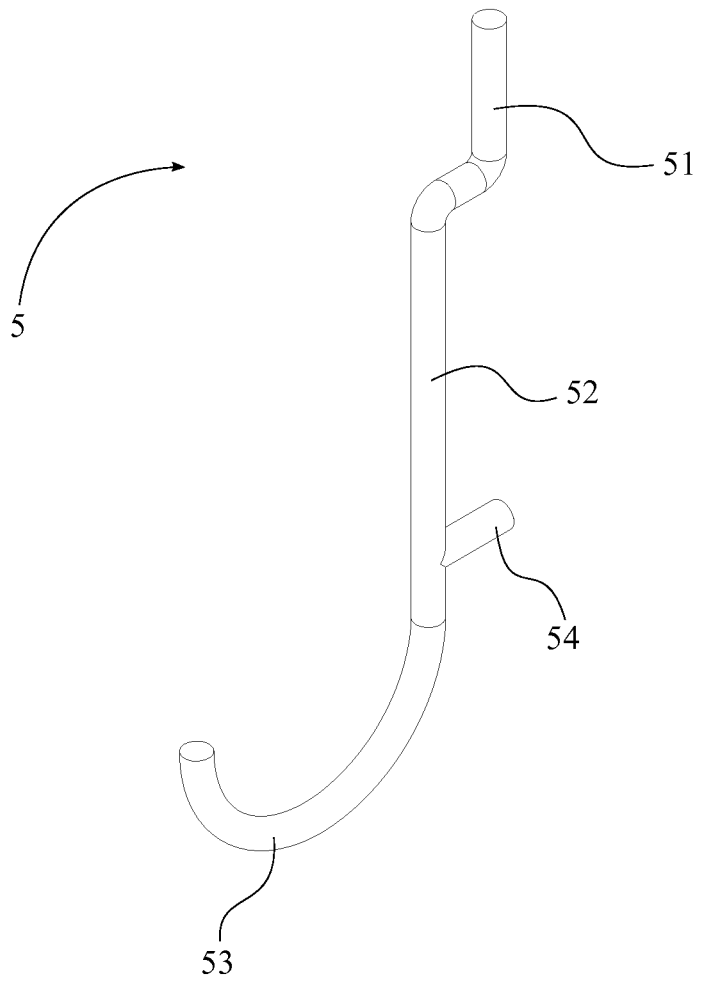
FIG. 6 is a perspective view of the at least one peg hook.
Figure 7:
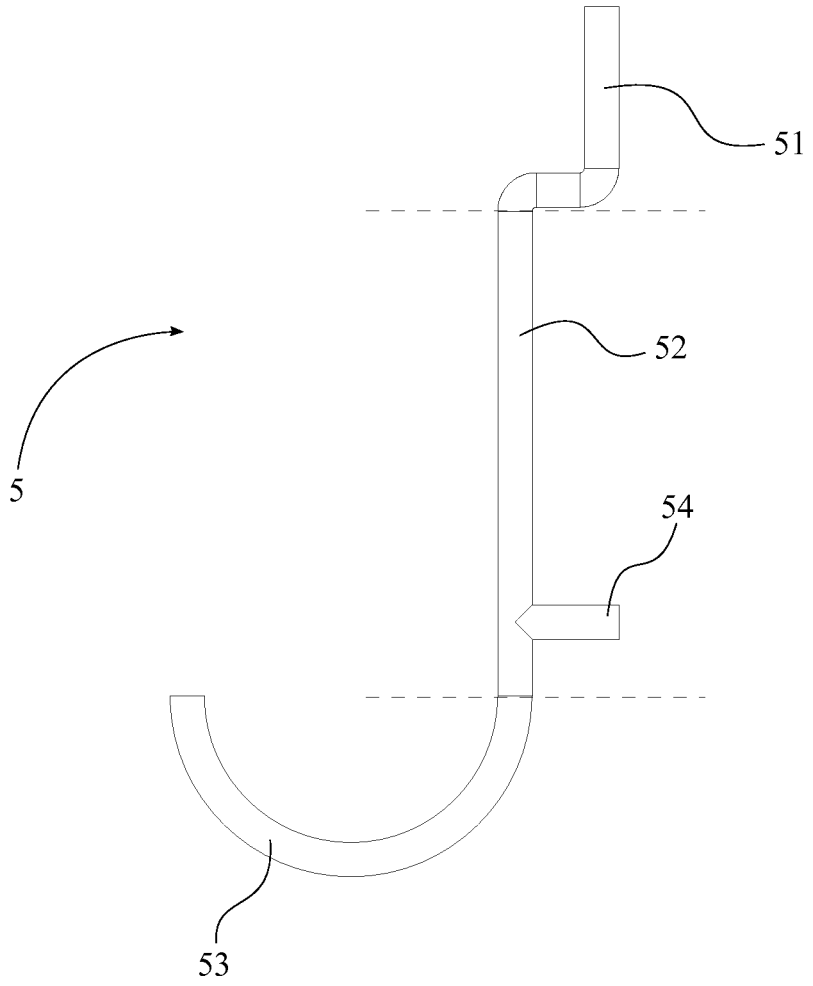
FIG. 7 is a side view of the at least one peg hook.
Figure 8:
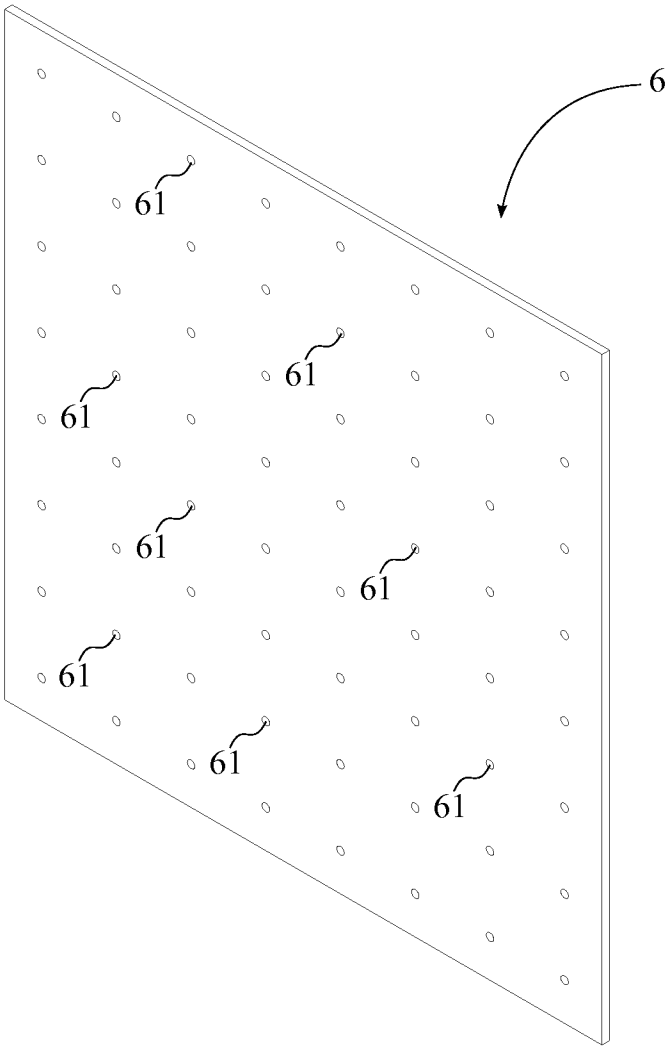
FIG. 8 is a perspective view of the perforated wall board.

In reference to FIG. 6 and FIG. 7, the at least one peg hook 5 comprises a locking section 51, an extending section 52, a hanging section 53, and a shank 54. More specifically, the locking section 51 is adjacently connected with the extending section 52, and the extending section 52 is adjacently connected with the hanging section 53 opposite from the locking section 51. The shank 54 is perpendicularly connected with the extending section 52 opposite from the hanging section 53. The at least one peg hook 5 can be any type of existing peg hook so that the wide variety of objects can be hanged. The locking section 51 and the shank 54 provide securing components to the at least one peg hook 5 while the hanging section 53 provides a surface area to suspend the wide variety of objects. The extending section 52 generally determines the height of the at least one peg hook 5 as the extending section 52 is linearly extended in between the locking section 51 and the hanging section 53. In reference to FIG. 8, the perforated wall board 6 comprises a plurality of holes 61 as the plurality of holes 61 is traversed through the perforated wall board 6. Each of the plurality of holes 61 is evenly distributed along the perforated wall board 6 in such way that the plurality of holes 61 creates vertical and horizontal lines within the perforated wall board 6.

Figure 9:
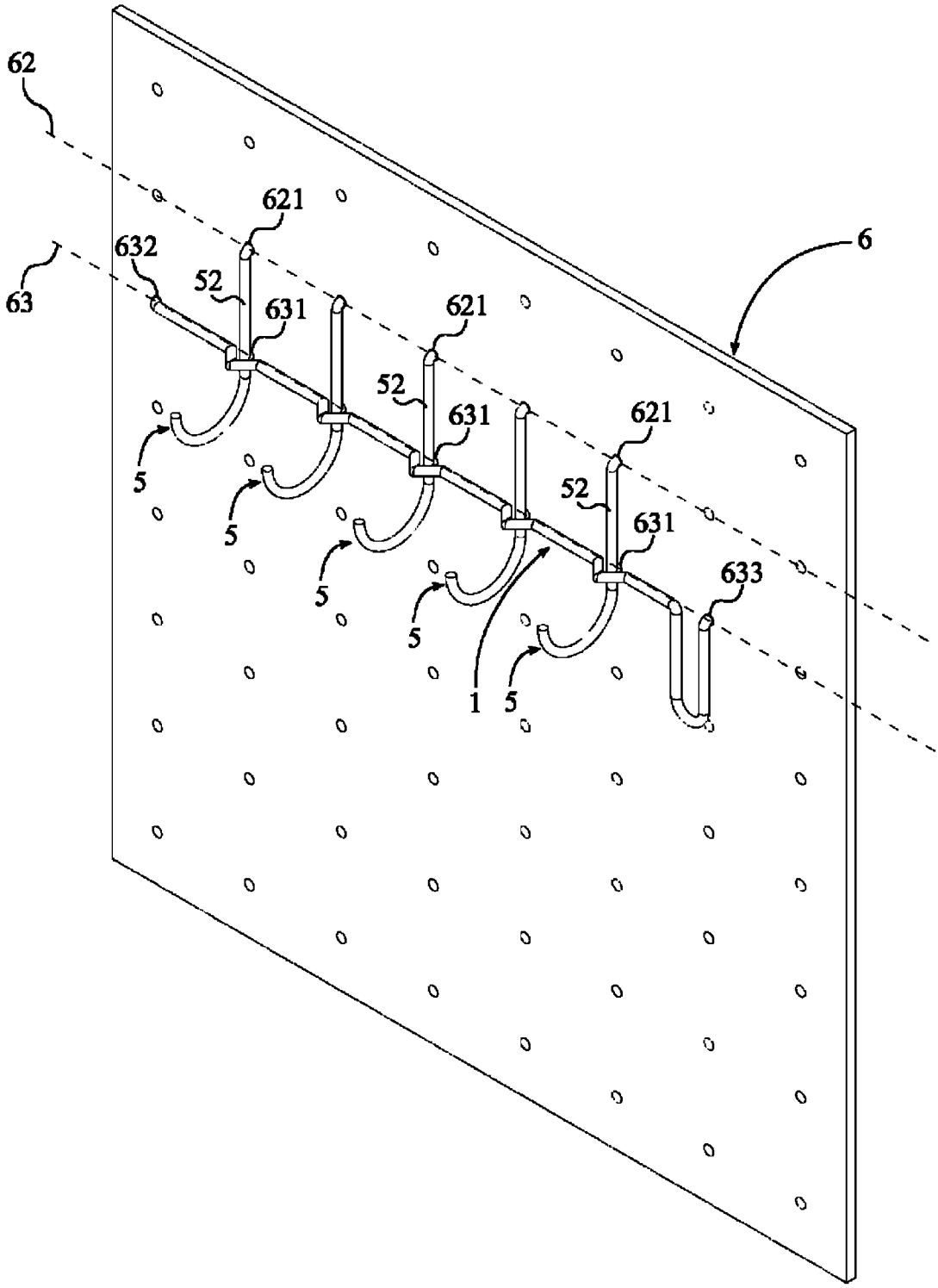
FIG. 9 is a perspective view of the present invention, showing in conjunction with the at least one peg hook and the perforated wall board.
Figure 10:
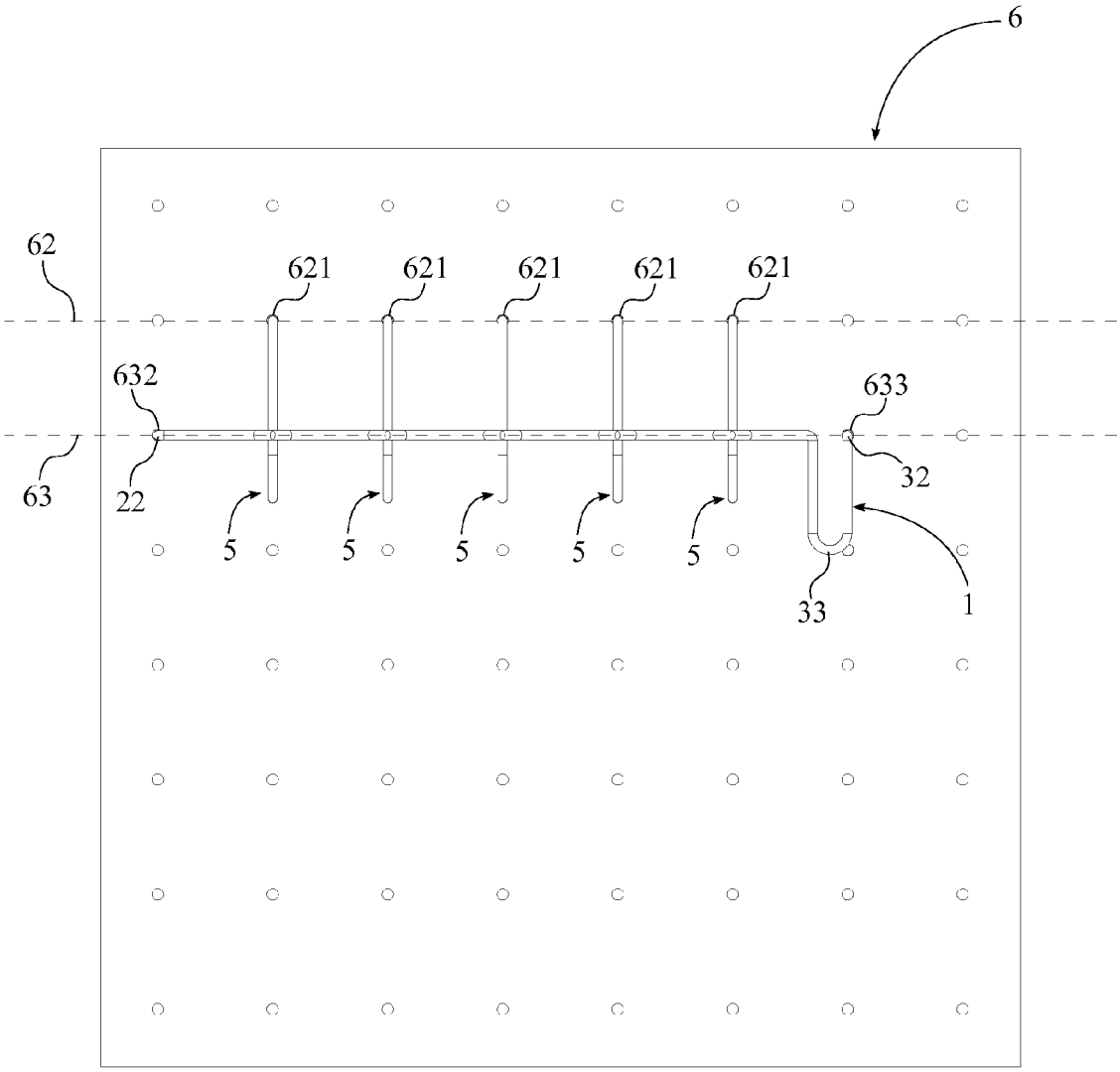
FIG. 10 is a front view of the present invention, showing in conjunction with the at least one peg hook and the perforated wall board.
Figure 11:
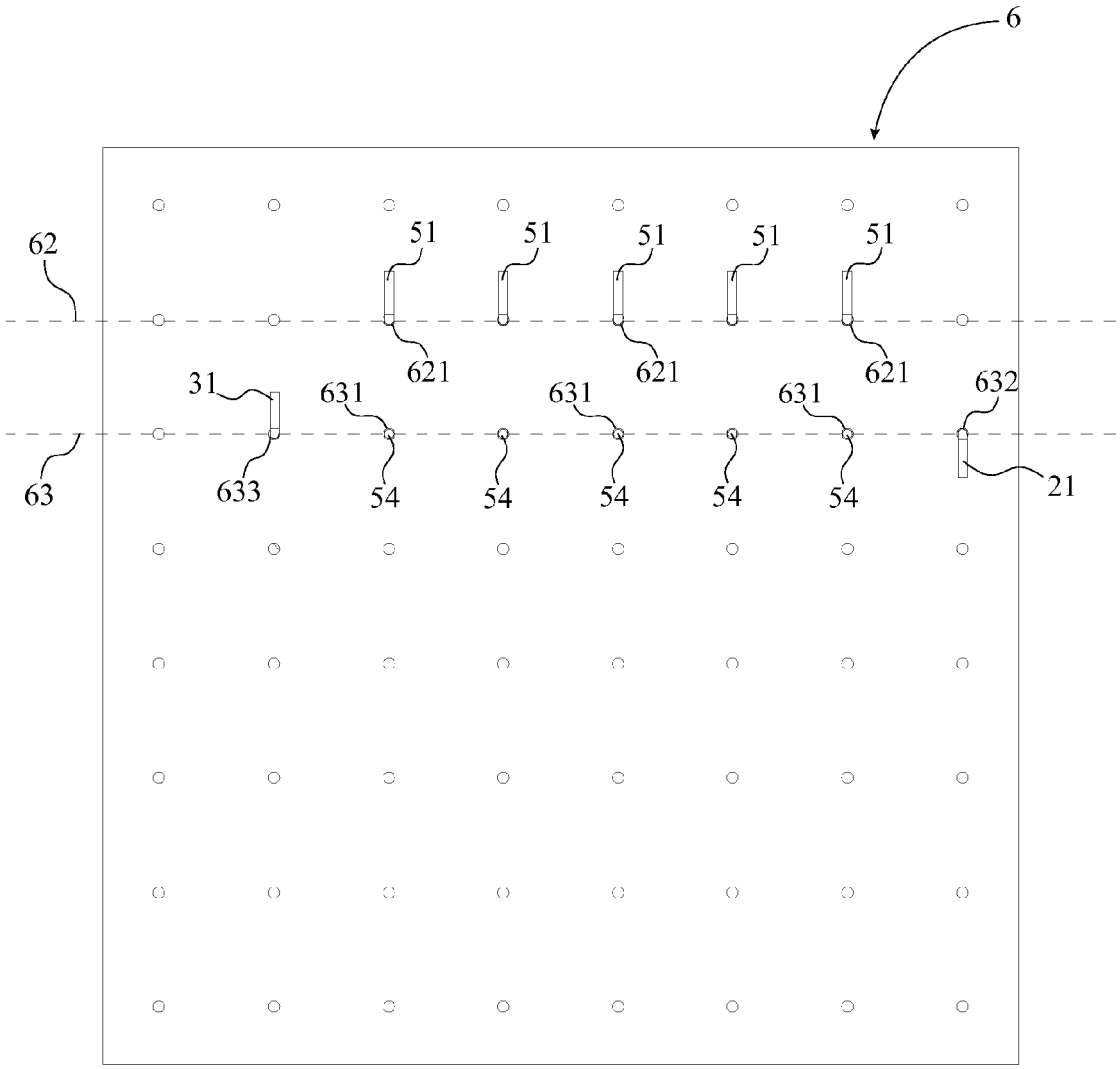
FIG. 11 is a back view of the present invention, showing in conjunction with the at least one peg hook and the perforated wall board.

In reference to FIG. 9-FIG. 11, when the present invention creates a system with the at least one peg hook 5 and the perforated wall board 6, the at least one peg hook 5 is attached with the perforated wall board 6 in such way that the peg hook staple 1 firmly secures the at least one peg hook 5 to the perforated wall board 6. More specifically, the plurality of holes 61 comprises an arbitrary line 62 and a corresponding lower line 63 so that the locking section 51 can be inserted into an upper hole 621 of the arbitrary line 62 and the shank 54 can be inserted into a lower hole 631 of the corresponding lower line 63. When the locking section 51 and the shank 54 are respectively inserted within the upper hole 621 and the lower hole 631, the extending section 52 is linearly positioned with the upper hole 621 and the lower hole 631. Once the at least one peg hook 5 is attached within the perforated wall board 6, the first extremity 2 is positioned within a first locking hole 632 of the corresponding lower line 63 in such way that the first retaining portion 22 is positioned within the first locking hole 632 and the first locking protrusion 21 is positioned behind the first locking hole 632 of the perforated wall board 6. Then the peg hook staple 1 is twisted upward from the handle portion 33 so that the second extremity 3 can be positioned within a second locking hole 633 of the corresponding lower line 63. When the peg hook staple 1 is twisted upward, the second locking protrusion 31 and the second retaining portion 32 can be inserted into the second locking hole 633. Then the peg hook staple 1 secures with the perforated wall board 6 through the first extremity 2 and the second extremity 3 as the handle portion 33 snaps against the perforated wall board 6. Once the second extremity 3 is attached within the perforated wall board 6, the second retaining portion 32 positions within the second locking hole 633 while the second locking protrusion 31 positions behind the second locking hole 633 of the perforated wall board 6. The peg hook staple 1 is able to firmly secure the at least one peg hook 5 due to the fact that the extending section 52 of the at least one peg hook 5 is positioned in between the perforated wall board 6 and the one of the plurality of indentations 43. The plurality of indentations 43 of the present invention is able to secure the at least one peg hook 5 firmly with the perforated wall board 6 as the plurality of indentations completely eliminates the lateral, upward, and outward movement of the at least one peg hook 5.

Once the present invention is secured within the perforated wall board 6, the natural spring back of the peg hook staple 1 locks in place and the at least one peg hook 5 is then secured in place. Other advantage of the present invention is that it attaches snuggly to all perforated wall boards 6 from generic ⅛" and 3/16" thick, including commercial which can be up to ¼" thick boards regardless of the hole sizes because the twisting effect of the present invention absorbs the difference in thicknesses of the perforated wall board 6. When the peg hook staple 1 needs to be removed from the perforated wall board 6 in order to remove or realign the at least one peg hook 5, the users can simply pull forward the handle portion 33 so that the peg hook staple 1 can be easily removed from the perforated wall board 6.

The present invention can be manufactured in various lengths and with any number of indentations 43 so that any number of peg hooks can be secured through the present invention. It also can be manufactured with various diameters and types of materials that are readily available, but the proper stiffness of the material is important as the present invention has to be a rigid component to avoid any kind of deformation overtime.

In an alternative embodiment of the present invention, the first extremity 2 may comprise a first retaining portion 22 along with the other components of the present invention. The first extremity 2 adjacently connected with the first end 41 while the second extremity 3 adjacently connects with the second end 42. All of the components and their configuration of the alternative embodiment stay similar to the preferred embodiment of the present invention apart from the first extremity 2. More specifically, the first retaining portion 22 is perpendicularly connected with the first end 41 in such way that the first retaining portion 22 is positioned normal to the plane 7 opposite from the plurality of indentations 43, without the first locking protrusion 21.

Although the invention has been explained in relation to its preferred embodiment, it is to be understood that many other possible modifications and variations can be made without departing from the spirit and scope of the invention as hereinafter claimed.

What is claimed is:

1. A peg hook securing apparatus comprises:

a peg hook staple;

a plane;

the peg hook staple comprises a first extremity, a second extremity, and a peg-securing cross member;

the first extremity comprises a first locking protrusion and a first retaining portion;

the second extremity comprises a second locking protrusion, a second retaining portion, and a handle portion; and the peg-securing cross member comprises a first end, a second end, and a plurality of indentations, and the plurality of indentations being positioned normal to the plane.

2. The peg hook securing apparatus as claimed in claim 1 comprises:

the first end and the second end being oppositely positioned from each other along the peg-securing cross member;

the plane being coincident with the peg-securing cross member;

the plurality of indentations being positioned along the peg-securing cross member;

the plurality of indentations being positioned in between the first end and the second end;

and the plurality of indentations being evenly distributed along the peg-securing cross member.

3. The peg hook securing apparatus as claimed in claim 1 comprises:

the first extremity being adjacently connected with the first end; and the second extremity being adjacently connected with the second end.

4. The peg hook securing apparatus as claimed in claim 1 comprises:

the first retaining portion being perpendicularly connected with the first end;

the first retaining portion being positioned normal to the plane opposite the plurality of indentations;

the first locking protrusion being perpendicularly connected with the first retaining portion; and the first locking protrusion being perpendicularly positioned with the peg-securing cross member.

5. The peg hook securing apparatus as claimed in claim 1 comprises:

the handle portion being perpendicularly connected with the second end;

the handle portion being positioned parallel to the plane;

the second retaining portion being perpendicularly connected the handle portion;

the second retaining portion being positioned normal to the plane opposite the plurality of indentations;

the second locking protrusion being perpendicularly connected with the second retaining portion; and the second locking protrusion being perpendicularly positioned with the peg-securing cross member.

6. The peg hook securing apparatus as claimed in claim 1 comprises:

the first locking protrusion and the second locking protrusion being oriented opposite to each other.

7. The peg hook securing apparatus as claimed in claim 1 comprises:

at least one peg hook;

a perforated wall board;

the at least one peg hook comprises a locking section, an extending section, a hanging section, and a shank;

the locking section being adjacently connected with the extending section;

the extending section being adjacently connected with the hanging section opposite from the locking section;

the shank being perpendicularly connected with the extending section;

the shank being oppositely positioned from the hanging section;

the perforated wall board comprises a plurality of holes; and the plurality of holes traversing through the perforated wall board.

8. The peg hook securing apparatus as claimed in claim 7 comprises:

the plurality holes comprises an arbitrary line and a corresponding lower line;

the locking section being inserted into an upper hole of the arbitrary line;

the shank being inserted into a lower hole of the corresponding lower line;

the extending section being linearly positioned with the upper hole and the lower hole;

the first retaining portion being positioned within a first locking hole of the corresponding lower line;

the first locking protrusion being positioned behind the first locking hole of the perforated wall board;

the second retaining portion being positioned within a second locking hole of the corresponding lower line;

the second locking protrusion being positioned behind the second locking hole of the perforated wall board; and the extending section being positioned in between the perforated wall board and the one of the plurality of indentations.

9. A peg hook securing apparatus comprises:

a peg hook staple;

a plane;

the peg hook staple comprises a first extremity, a second extremity, and a peg-securing cross member;

the first extremity comprises a first locking protrusion and a first retaining portion;

the second extremity comprises a second locking protrusion, a second retaining portion, and a handle portion;

the peg-securing cross member comprises a first end, a second end, and a plurality of indentations;

the first end and the second end being oppositely positioned from each other along the peg-securing cross member;

the plane being coincident with the peg-securing cross member;

the plurality of indentations being positioned along the peg-securing cross member;

the plurality of indentations being positioned in between the first end and the second end;

the plurality of indentations being positioned normal to the plane; and the plurality of indentations being evenly distributed along the peg-securing cross member.

10. The peg hook securing apparatus as claimed in claim 9 comprises:

the first extremity being adjacently connected with the first end; and the second extremity being adjacently connected with the second end.

11. The peg hook securing apparatus as claimed in claim 9 comprises:

the first retaining portion being perpendicularly connected with the first end;

the first retaining portion being positioned normal to the plane opposite the plurality of indentations;

the first locking protrusion being perpendicularly connected with the first retaining portion; and the first locking protrusion being perpendicularly positioned with the peg-securing cross member.

12. The peg hook securing apparatus as claimed in claim 9 comprises:

the handle portion being perpendicularly connected with the second end;

the handle portion being positioned parallel to the plane;

the second retaining portion being perpendicularly connected the handle portion;

the second retaining portion being positioned normal to the plane opposite the plurality of indentations;

the second locking protrusion being perpendicularly connected with the second retaining portion; and the second locking protrusion being perpendicularly positioned with the peg-securing cross member.

13. The peg hook securing apparatus as claimed in claim 9 comprises:

the first locking protrusion and the second locking protrusion being oriented opposite to each other.

14. The peg hook securing apparatus as claimed in claim 9 comprises:

at least one peg hook;

a perforated wall board;

the at least one peg hook comprises a locking section, an extending section, a hanging section, and a shank;

the locking section being adjacently connected with the extending section;

the extending section being adjacently connected with the hanging section opposite from the locking section;

the shank being perpendicularly connected with the extending section;

the shank being oppositely positioned from the hanging section;

the perforated wall board comprises a plurality of holes; and the plurality of holes traversing through the perforated wall board.

15. The peg hook securing apparatus as claimed in claim 14 comprises:

the plurality holes comprises an arbitrary line and a corresponding lower line;

the locking section being inserted into an upper hole of the arbitrary line;

the shank being inserted into a lower hole of the corresponding lower line;

the extending section being linearly positioned with the upper hole and the lower hole;

the first retaining portion being positioned within a first locking hole of the corresponding lower line;

the first locking protrusion being positioned behind the first locking hole of the perforated wall board;

the second retaining portion being positioned within a second locking hole of the corresponding lower line;

the second locking protrusion being positioned behind the second locking hole of the perforated wall board; and the extending section being positioned in between the perforated wall board and the one of the plurality of indentations.

16. A peg hook securing apparatus comprises:

a peg hook staple;

a plane;

the peg hook staple comprises a first extremity, a second extremity, and a peg-securing cross member;

the first extremity comprises a first locking protrusion and a first retaining portion;

the second extremity comprises a second locking protrusion, a second retaining portion, and a handle portion;

the peg-securing cross member comprises a first end, a second end, and a plurality of indentations;

the first end and the second end being oppositely positioned from each other along the peg-securing cross member;

the plane being coincident with the peg-securing cross member;

the plurality of indentations being positioned along the peg-securing cross member;

the plurality of indentations being positioned in between the first end and the second end;

the plurality of indentations being positioned normal to the plane;

the plurality of indentations being evenly distributed along the peg-securing cross member;

the first extremity being adjacently connected with the first end; and the second extremity being adjacently connected with the second end.

17. The peg hook securing apparatus as claimed in claim 16 comprises:

the first retaining portion being perpendicularly connected with the first end;

the first retaining portion being positioned normal to the plane opposite the plurality of indentations;

the first locking protrusion being perpendicularly connected with the first retaining portion; and the first locking protrusion being perpendicularly positioned with the peg-securing cross member.

18. The peg hook securing apparatus as claimed in claim 16 comprises:

the handle portion being perpendicularly connected with the second end;

the handle portion being positioned parallel to the plane;

the second retaining portion being perpendicularly connected the handle portion;

the second retaining portion being positioned normal to the plane opposite the plurality of indentations;

the second locking protrusion being perpendicularly connected with the second retaining portion; and the second locking protrusion being perpendicularly positioned with the peg-securing cross member.

19. The peg hook securing apparatus as claimed in claim 16 comprises:

the first locking protrusion and the second locking protrusion being oriented opposite to each other.

20. The peg hook securing apparatus as claimed in claim 19 comprises:

at least one peg hook;

a perforated wall board;

the at least one peg hook comprises a locking section, an extending section, a hanging section, and a shank;

the locking section being adjacently connected with the extending section;

the extending section being adjacently connected with the hanging section opposite from the locking section;

the shank being perpendicularly connected with the extending section;

the shank being oppositely positioned from the hanging section;

the perforated wall board comprises a plurality of holes;

the plurality of holes traversing through the perforated wall board;

the plurality holes comprises an arbitrary line and a corresponding lower line;

the locking section being inserted into an upper hole of the arbitrary line;

the shank being inserted into a lower hole of the corresponding lower line;

the extending section being linearly positioned with the upper hole and the lower hole;

the first retaining portion being positioned within a first locking hole of the corresponding lower line;

the first locking protrusion being positioned behind the first locking hole of the perforated wall board;

the second retaining portion being positioned within a second locking hole of the corresponding lower line;

the second locking protrusion being positioned behind the second locking hole of the perforated wall board; and the extending section being positioned in between the perforated wall board and the one of the plurality of indentations.

* * * * *